US006904683B2

(12) United States Patent
Shinoda et al.

(10) Patent No.: US 6,904,683 B2
(45) Date of Patent: Jun. 14, 2005

(54) NAIL CLIPPERS

(75) Inventors: Yasuyuki Shinoda, Seki (JP); Takashi Koide, Seki (JP)

(73) Assignee: KAI R&D Center Co., Ltd., Gifu (JP)

( * ) Notice: Subject to any disclaimer, the term of this patent is extended or adjusted under 35 U.S.C. 154(b) by 156 days.

(21) Appl. No.: 10/181,195

(22) PCT Filed: Nov. 13, 2001

(86) PCT No.: PCT/JP01/09925

§ 371 (c)(1),
(2), (4) Date: Jul. 10, 2002

(87) PCT Pub. No.: WO02/39844

PCT Pub. Date: May 23, 2002

(65) Prior Publication Data

US 2003/0000090 A1 Jan. 2, 2003

(30) Foreign Application Priority Data

Nov. 16, 2000 (JP) ..... 2000-349477

(51) Int. Cl.[7] ..... A45D 29/00
(52) U.S. Cl. ..... 30/28; 132/75.5
(58) Field of Search ..... 30/26, 28, 29, 30/124, 27, 75.5, 73.5; 400/500–510; 132/73.5, 75.5; D28/60; 411/500–510

(56) References Cited

U.S. PATENT DOCUMENTS 1,394,727 A * 10/1921 Gronbech ..... 30/28
2,460,522 A * 2/1949 Miller ..... 30/28
3,093,898 A 6/1963 Smith
3,630,116 A * 12/1971 Harper ..... 411/504
3,986,257 A * 10/1976 Kiura ..... 30/28
4,230,016 A * 10/1980 Merrell ..... 411/378
4,614,031 A * 9/1986 Chen ..... 30/28

FOREIGN PATENT DOCUMENTS

| | | |
|---|---|---|
| JP | 61-82502 | 5/1986 |
| JP | 2-44204 | 10/1990 |
| JP | 3-119307 | 12/1991 |
| JP | 4-68706 | 6/1992 |
| JP | 09 182613 A | 7/1997 |

* cited by examiner

*Primary Examiner*—Boyer Ashley
*Assistant Examiner*—Isaac Hamilton
(74) *Attorney, Agent, or Firm*—Townsend and Townsend and Crew LLP

(57) ABSTRACT

The nail clipper contains a pair of blade bodies each having a cutting edge, a lever to be operated for bringing the cutting edges of the blade bodies into press contact with each other and a supporting shaft for linking the lever to the blade bodies; the cutting edges of the blade bodies being brought into press contact with each other by pressing the blade bodies with the lever against resilience of the blade bodies. The nail clipper is provided with bosses formed either on the lever or on the supporting shaft, so as to allow the supporting shaft to pivotally support the lever; and grooves formed on the rest of the supporting shaft and the lever, with which the bosses are engaged. Each groove has a mouth portion through which the boss is engaged and disengaged, a guiding portion capable of pivotally supporting the boss, and a connecting portion connecting the mouth portion and the guiding portion to each other. The groove has a pair of side wall surfaces opposing each other in the mouth portion, connecting portion and guiding portion and also a bottom surface connecting the side wall surfaces to each other.

22 Claims, 9 Drawing Sheets

NAIL CLIPPERS

This application claims the benefit of International Patent Application No. PCT/JP01/09925 filed on Nov. 13, 2001.

BACKGROUND OF THE INVENTION

The present invention relates to nail clippers.

A conventional nail clipper, for example, as shown in Japanese Unexamined Utility Model Publication No. Sho 61-82502 has a supporting shaft which is notched to form a bearing hole, and a connecting pin attached to a lever is inserted to the bearing hole. In this nail clipper, although the lever can be incorporated into the supporting shaft easily by virtue of the bearing hole opening to the periphery of the shaft, this configuration per se involves problems that the connecting pin of the lever easily slips off the bearing hole of the supporting shaft and that the strength of the portion of the supporting shaft around the bearing hole is lowered. In addition, it is troublesome to form a supporting shaft having such a shape of bearing hole as described above.

It is an objective of the present invention to provide nail clippers, capable of facilitating incorporation of a lever, ensuring bearing of the lever and enhancing the strength of the supporting section. It is another objective of the present invention to provide a nail clipper whose supporting shaft can be molded easily.

BRIEF SUMMARY OF THE INVENTION

In order to attain the objectives as described above, the nail clipper according to one aspect of the present invention contains a pair of blade bodies each having a cutting edge, a lever to be operated for bringing the cutting edges of the blade bodies into press contact with each other and a supporting shaft for linking the lever to the blade bodies. The cutting edges of the blade bodies are adapted to be brought into press contact with each other by pressing the blade bodies with the lever against resilience of the blade bodies. The nail clipper is provided with a boss formed either on the lever or on the supporting shaft so as to allow the supporting shaft to pivotally support the lever, and a groove formed on the rest of the supporting shaft and the lever, with which the boss is engaged. The groove has a mouth portion through which the boss is engaged and disengaged, a guiding portion capable of pivotally supporting the boss, and a connecting portion connecting the mouth portion and the guiding portion to each other. Further, the groove has a pair of side wall surfaces opposing each other in the mouth portion, connecting portion and guiding portion and also a bottom surface connecting the side wall surfaces to each other.

The nail clipper according to another embodiment contains an upper blade body having an upper cutting edge; a lower blade body having a lower cutting edge opposed to the upper cutting edge; a supporting shaft inserted to the blade bodies near the cutting edges respectively, a lower end portion of the supporting shaft being engaged with the lower blade body to be locked therewith, while an upper end portion of the supporting shaft protrudes upward through the upper blade body; and a lever having a first supporting section; the first supporting section being linked on the upper blade body to a second supporting section provided at an upper end portion of the supporting shaft; wherein the cutting edges of the blade bodies are brought into press contact with each other by pressing the upper blade body with the lever against resilience of the upper and lower blade bodies. In this nail clipper, either the first supporting section of the lever or the second supporting section of the supporting shaft is a boss, while the other supporting section is a groove, with which the boss is engaged. The groove contains a mouth portion through which the boss is engaged and disengaged, a guiding portion capable of pivotally supporting the boss, and a connecting portion connecting the mouth portion and the guiding portion to each other. The groove has a pair of side wall surfaces opposing each other in the mouth portion, connecting portion and guiding portion and also a bottom surface connecting the side wall surfaces to each other.

The nail clipper according another embodiment contains an upper blade body having an upper cutting edge; a lower blade body having a lower cutting edge opposed to the upper cutting edge; a supporting shaft inserted to the blade bodies near the cutting edges respectively, a lower end portion of the supporting shaft being engaged with the lower blade body, while an upper end portion of the supporting shaft protrudes upward through the upper blade body; a lever having a pair of supporting arms; the upper end portion of the supporting shaft being inserted on the upper blade body to a bearing recess defined between the supporting arms of the lever; a first supporting section provided in the supporting arms; and a second supporting section provided at the upper end portion of the supporting shaft; the first and second supporting sections being linked to each other; wherein the upper cutting edge and the lower cutting edge are brought into press contact with each other by pressing the upper blade body with the lever against resilience of the upper and lower blade bodies. In this nail clipper, either the first supporting section of the lever or the second supporting section of the supporting shaft is a pair of bosses opposing each other, and the other supporting section is a pair of grooves, with which the bosses are engaged respectively. Each groove has a mouth portion through which the boss is engaged and disengaged, a guiding portion capable of pivotally supporting the boss, and a connecting portion connecting the mouth portion and the guiding portion to each other. Each groove has a pair of side wall surfaces opposing each other in the mouth portion, connecting portion and guiding portion and also a bottom surface connecting the side wall surfaces to each other.

The nail clipper according to another embodiment contains an upper blade body having an upper cutting edge; a lower blade body having a lower cutting edge opposed to the upper cutting edge; a supporting shaft inserted to the blade bodies near the cutting edges respectively, a lower end portion of the supporting shaft being engaged with the lower blade body to be locked therewith, while an upper end portion of the supporting shaft protrudes upward through the upper blade body; and a lever having a pair of supporting arms; the upper end portion of the supporting shaft being inserted on the upper blade body to a bearing recess defined between the supporting arms of the lever; a first supporting section provided in the supporting arms; and a second supporting section provided at the upper end portion of the supporting shaft; the first and second supporting sections being linked to each other; wherein the upper cutting edge and the lower cutting edge are brought into press contact with each other by pressing the upper blade body with the lever against resilience of the upper and lower blade bodies. In this nail clipper, the first supporting section of the lever is a pair of bosses protruding from the supporting arms respectively to oppose each other in the bearing recess of the lever; whereas the second supporting section of the supporting shaft is a groove formed continuously fully along the circumference thereof, with which the bosses are engaged. Each groove has a mouth portion through which the bosses are engaged and disengaged and a guiding portion capable of pivotally supporting the bosses.

The nail clipper according to another embodiment contains an upper blade body having an upper cutting edge; a lower blade body having a lower cutting edge opposed to the upper cutting edge; a supporting shaft inserted to the blade bodies near the cutting edges respectively, a lower end portion of the supporting shaft being engaged with the lower blade body to be locked therewith, while an upper end portion of the supporting shaft protrudes upward through the upper blade body; a first supporting section provided in a lever; and a second supporting section provided at the upper end portion of the supporting shaft, the first and second supporting sections being linked to each other; wherein the upper cutting edge and the lower cutting edge are brought into press contact with each other by pressing the upper blade body with the lever against resilience of the upper and lower blade bodies. In this nail clipper, the supporting shaft is molded with a synthetic resin material.

BRIEF DESCRIPTION OF THE DRAWINGS

FIG. 1(*b*) is a perspective view showing the supporting shaft of the nail clipper; and FIG. 1(*c*) is a perspective view showing the lever of the nail clipper;

FIG. 2(*b*) is a left side view of the supporting shaft shown in FIG. 2(*a*); and FIG. 2(*c*) is a bottom view of the supporting shaft shown in FIG. 2(*a*);

FIG. 3(*b*) is a cross-sectional view taken along the line 3*b*—3*b* in FIG. 2(*a*); and FIG. 3(*c*) is a cross-sectional view taken along the line 3*c*—3*c* in FIG. 2(*a*);

FIG. 4(*b*) is a left side view of the lever shown in FIG. 4(*a*);

FIG. 6(*b*) is a cross-sectional view taken along the line 6*b*—6*b* in FIG. 5(*c*);

FIG. 7(*b*) is a front view thereof showing a state where the nail clipper is in action;

FIG. 8(*b*) is a left side view of the supporting shaft shown in FIG. 8(*a*); FIG. 8(*c*) is a cross-sectional view taken along the liner 8*c*—8*c* in FIG. 8(*a*); and FIG. 8(*d*) is a cross-sectional view taken along the line 8*d*—8*d* in FIG. 8(*a*);

FIG. 9(*b*) is a cross-sectional view showing the bosses; FIG. 10(*b*) is a cross-sectional view taken along the line 10*b*—10*b* in FIG. 10(*a*).

DETAILED DESCRIPTION OF THE PREFERRED EMBODIMENTS

The nail clipper according to a first embodiment of the present invention will be described below referring to FIGS. 1 to 7.

Scheme of Nail Clipper

Figure 1:
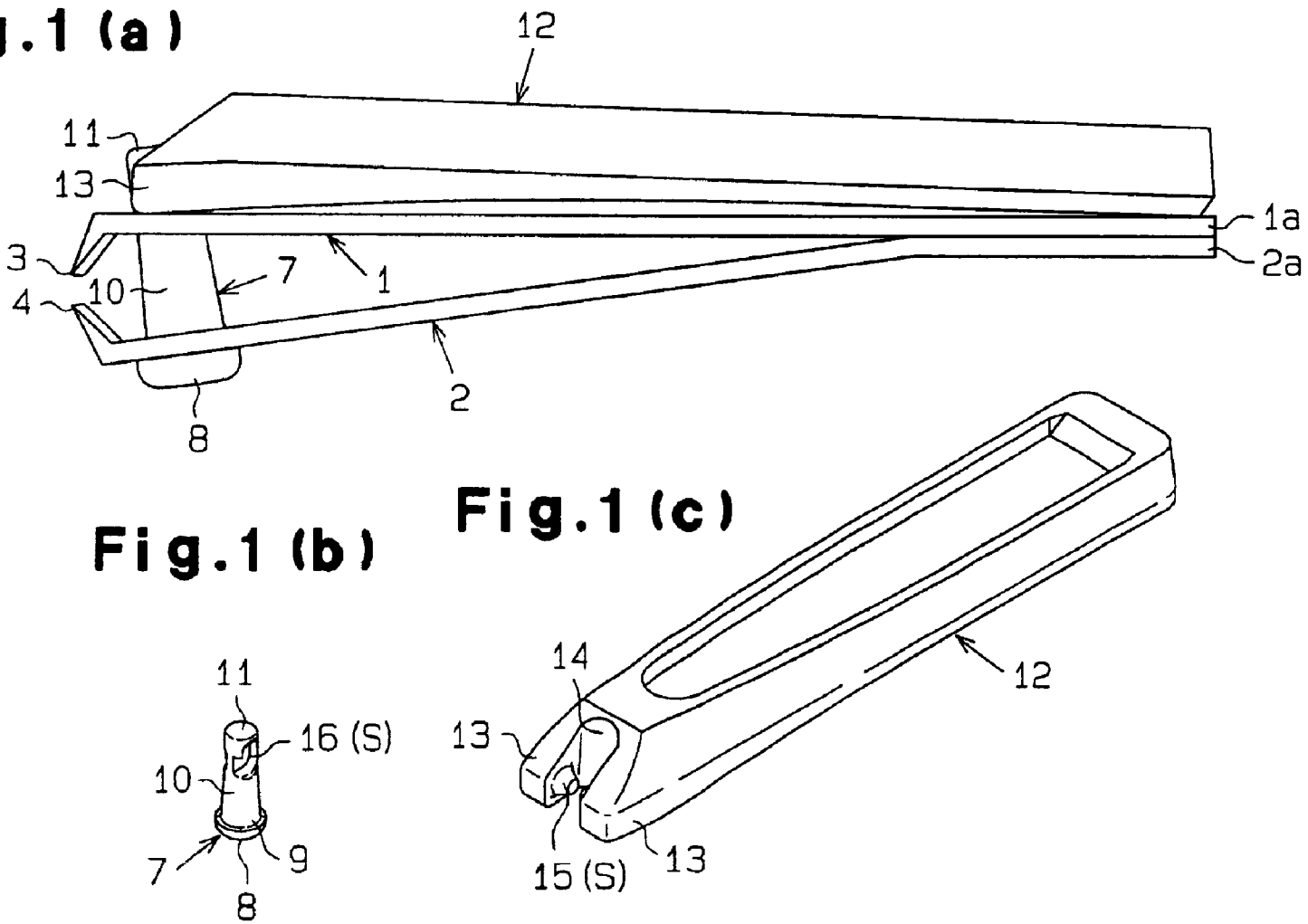
FIG. 1(*a*) is a front view of the nail clipper according to a first embodiment, showing a state where the nail clipper is at rest.
Figure 5A:
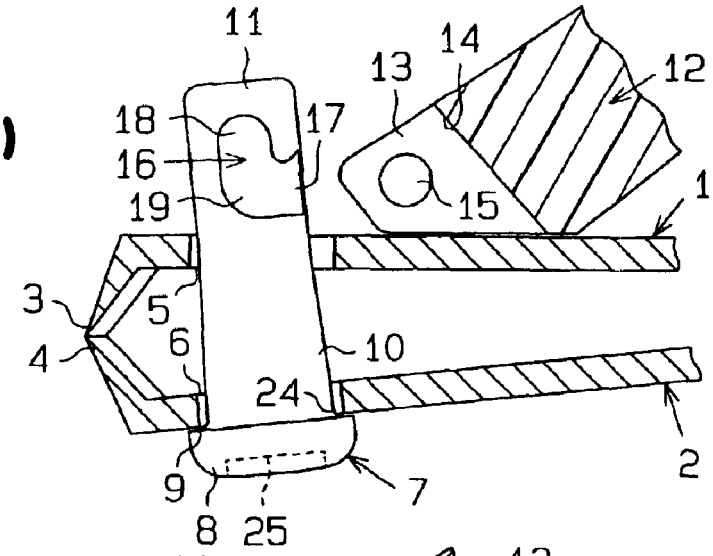
FIGS. 5(*a*), 5(*b*) and 5(*c*) are partial cross-sectional views showing process steps of engaging the pair of bosses of the lever with the grooves of the supporting shaft.
Figure 5B:
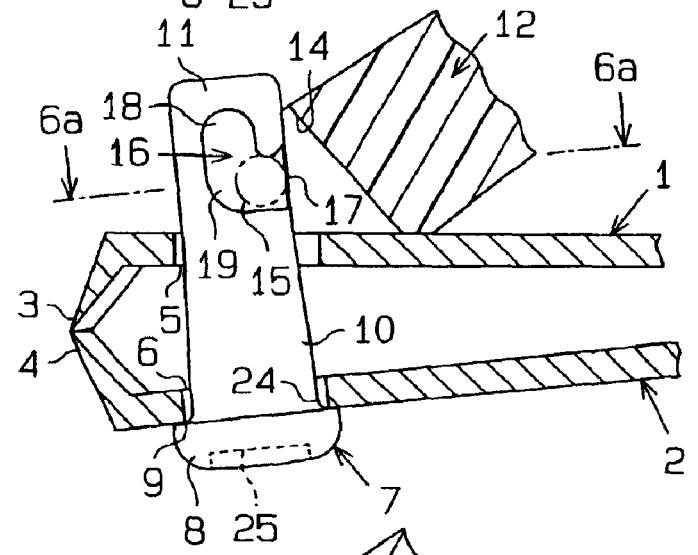
Figure 5C:
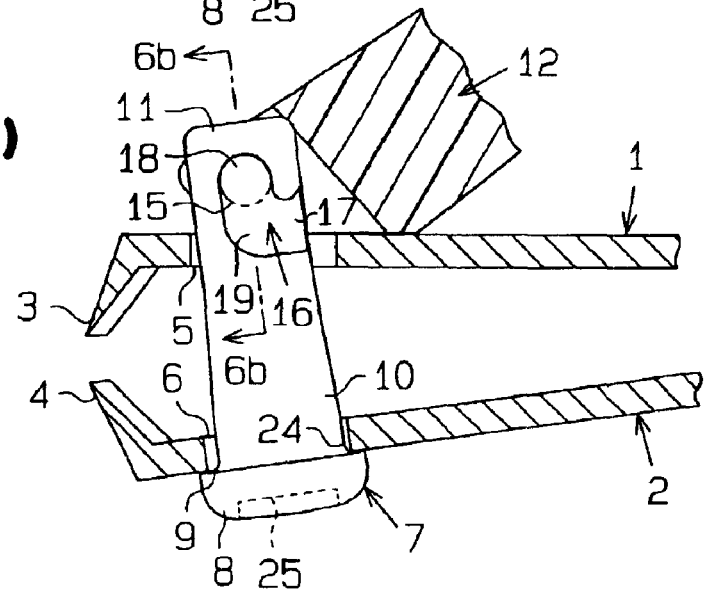
Figure 6A:
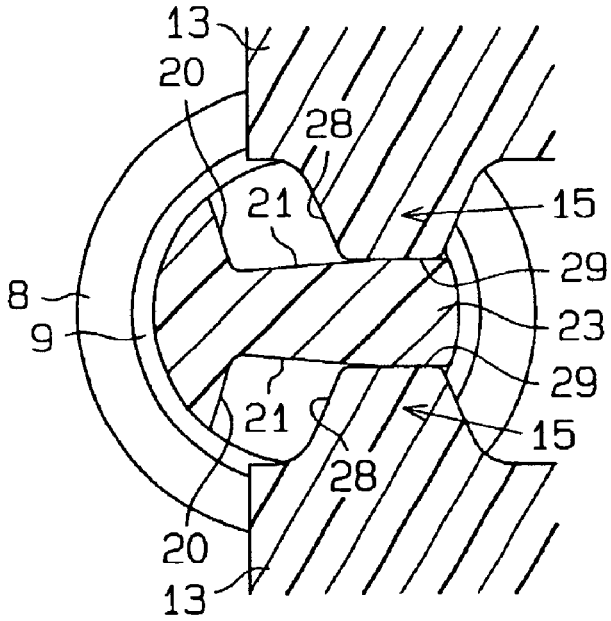
FIG. 6(*a*) is a cross-sectional view taken along the line 6*a*—6*a* in FIG. 5(*b*)
Figure 6B:
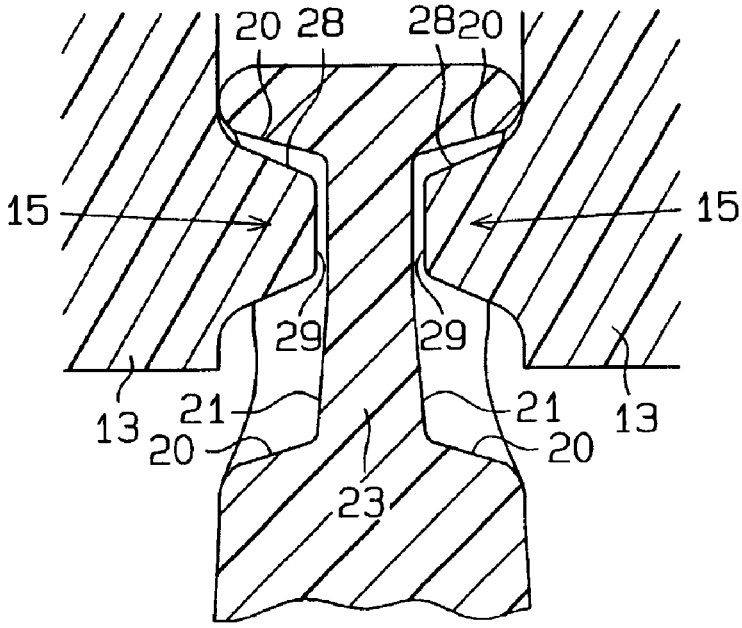

As shown in FIG. 1(*a*), the nail clipper has an upper blade body 1 and a lower blade body 2 each having a plate form, which are fixed to each other at proximal portions 1*a* and 2*a*. The upper blade body 1 and the lower blade body 2 have resilience and can be moved closer to and away from each other. The upper blade body 1 and the lower blade body 2 have cutting edges 3 and 4 formed at the distal ends thereof respectively to oppose each other. The upper cutting edge 3 and the lower cutting edge 4 are normally spaced away from each other by the resilience of the blade bodies 1 and 2. As shown in FIGS. 5(*a*), 5(*b*) and 5(*c*), circular bearing holes 5 and 6 are defined through the upper blade body 1 and the lower blade body 2, and they are located near the cutting edges 3 and 4, respectively.

A supporting shaft 7 shown in FIG. 1(*b*) penetrates the upper blade body 1 through the bearing hole 5 thereof and the lower blade body 2 through the bearing hole 6 thereof. This supporting shaft 7 contains a large-diameter head 8 formed at the lower end thereof and a small-diameter shank 10 extended from the head 8 upward through a step 9. The head 8 is locked by the rim of the bearing hole 6 on the lower side of the lower blade body 2. An upper end portion 11 of the shank 10 protrudes through the bearing hole 5 to the upper side of the upper blade body 1.

A lever 12 shown in FIG. 1(*c*) is placed on the upper side of the upper blade body 1. The lever 12 is forked at the distal portion to form a pair of supporting arms 13 and also a bearing recess 14 between these two supporting arms 13. The upper end portion 11 of the supporting shaft 7 is inserted to this bearing recess 14. Each supporting arm 13 of the lever 12 and the upper end portion 11 of the supporting shaft 7 are linked to each other in a supporting section S.

Materials of Supporting Shaft 7 and Lever 12

Both the supporting shaft 7 and the lever 12 are integrally molded respectively with a synthetic resin material. The synthetic resin material is based on polyamide, polypropylene or aromatic nylon and can contain a predetermined filler. As the filler, a glass fiber, a mineral fiber or a carbon fiber can be used singly, or a combination of at least two of the glass fiber, mineral fiber and carbon fiber may be used. Provided that the content (wt %) of such fillers is $\alpha$, the value $\alpha$ is defined in this embodiment as $15\% \leqq \alpha \leqq 65\%$. However, it is preferably $40\% \leqq \alpha \leqq 60\%$.

The following characteristics can be obtained by utilizing such synthetic resins.

(1) Synthetic resins have high strength and high rigidity after wetting or at high temperatures, high impact strength and high elongation at break as rigid materials and excellent fatigue strength, so that the shaft 7 and the lever 12 come to have high strength and rigidity.

(2) Synthetic resins have good fluidity and provide good appearance, since they can be subjected to injection molding at a mold temperature of 80 to 110° C. and since dies, screws and cylinders do not wear much; and (3) Synthetic resins do not wear much when they are brought into contact with metallic materials to improve wear resistance of the shaft 7 and of the lever 12.

Linking Structure of Supporting Shaft 7 and Lever 12

As shown in FIG. 1(*c*), in the bearing recess 14 of the lever 12, a boss 15 (supporting section S) is formed on each supporting arm 13 such that the boss formed on one supporting arm 13 opposes the counterpart formed on the other supporting arm 13. Both the head 8 and the shank 10 of the supporting shaft 7 are formed to have circular cross sections respectively. The shank 10 has on each side of the circumference thereof a pair of grooves 16 (supporting section S)

at 180° intervals to oppose the bosses 15 respectively, and the bosses 15 are engaged with the opposing grooves 16 respectively.

Figure 3A:
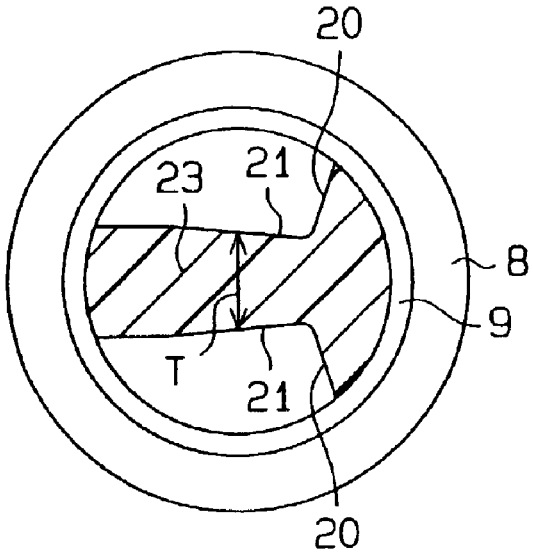
FIG. 3(*a*) is a cross-sectional view taken along the line 3*a*—3*a* in FIG. 2(*a*)
Figure 3B:
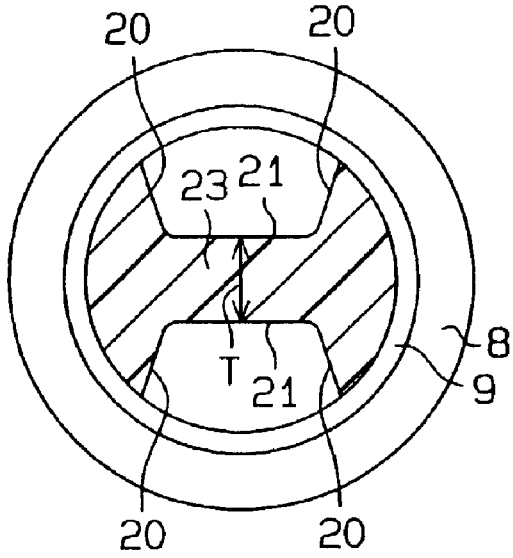
Figure 3C:
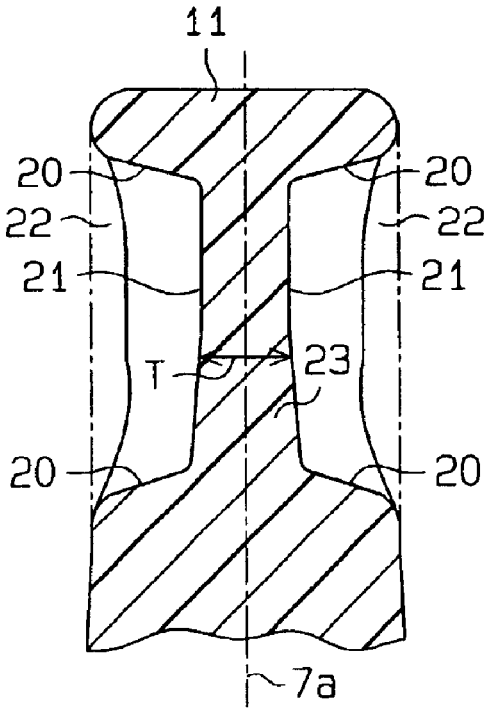

As shown in FIGS. 1(*b*), 2(*a*) to 2(*c*) and FIGS. 3(*a*) to 3(*c*), each groove 16 contains a mouth portion 17 engageable with and disengageable from the boss 15, a guiding portion 18 capable of pivotally supporting the boss 15, and a connecting portion 19 connecting the mouth portion 17 and the guiding portion 18 to each other. Each groove 16 has a pair of opposing side wall surfaces 20 in the mouth portion 17, connecting portion 19 and guiding portion 18; a bottom surface 21 connecting the pair of side wall surfaces 20 to each other in the mouth portion 17, connecting portion 19 and guiding portion 18; and an opening 22 opposing the bottom surface 21. The pair of grooves 16 are separated from each other by a common bottom plate 23 throughout the mouth portion 17, connecting portion 19 and guiding portion 18. The bottom surfaces 21 of the grooves 16 are located on each side of the bottom plate 23 in the mouth portion 17, connecting portion 19 and guiding portion 18.

The center line between the pair of side wall surfaces 20 in each groove 16 extends throughout the mouth portion 17, connecting portion 19 and guiding portion 18. The center line contains a first portion 17*a* running through the mouth portion 17, a second portion 19*a* running through the connecting portion 19 and a third portion 18*a* running through the guiding portion 18. The first portion 17*a* extends from the mouth portion 17 to the connecting portion 19 orthogonally to the axial direction 7*a* of the supporting shaft 7. The third portion 18*a* extends from the connecting portion 19 to the guiding portion 18 along the axial direction 7*a* of the supporting shaft 7. The second portion 19*a* is arcuated to connect the first portion 17*a* and the third portion 18*a* to each other.

The pair of side wall surfaces 20 in each groove 16 are inclined to be away from each other toward the opening 22. Thus, the distance W between the side wall surfaces 20 in each groove 16 is designed to be greater on the opening (22) side than on the bottom surface (21) side.

Provided that the thickness of the bottom plate 23 or the distance between the bottom surfaces 21 of the grooves 16 is T; the distance between the opening 22 of the grooves 16 or the outside diameter of the shank 10 of the supporting shaft 7 is $D_{10}$; and that the value T (thickness)/$D_{10}$ (outside diameter) is A, the value A is set within the range of $0 \leqq A \leqq 0.5$. More preferably, the value A is set within the range of $0.2 \leqq A \leqq 0.4$. In each groove 16 of this embodiment, the bottom plate 23 is formed throughout the mouth portion 17, connecting portion 19 and guiding portion 18. However, for example, the bottom plate 23 may be formed in the mouth portion 17 and a part of the connecting portion 19, and the bottom plate 23 may be omitted in the rest of the connecting portion 19 and in the guiding portion 18 to allow the grooves 16 to communicate with each other. In the case where the bottom plate 23 is omitted, T=0, and hence A=0.

Provided that the distance between the side wall surfaces 20 in the guiding portion 18 of each groove 16 and the outside diameter of the shank 10 of the supporting shaft 7 are W and $D_{10}$ respectively and that the value W (distance)/$D_{10}$ (outside diameter) is B, the value B is set within the range of $0.15 \leqq B \leqq 0.8$ in this embodiment. The value B is more preferably set within the range of $0.4 \leqq B \leqq 0.7$.

In the supporting shaft 7, the outside diameter $D_8$ of the head 8 is designed to be greater than the outside diameter $D_{10}$ of the shank 10. Provided that the length of the head 8 along the axial direction 7*a* and the length of the shank 10 along the axial direction 7*a* are H and L respectively and that the value H (width)/L (length) is C, the value C is set within the range of $0.05 \leqq C \leqq 0.3$ in this embodiment. The value C is more preferably set within the range of $0.1 \leqq C \leqq 0.2$.

Further, in the supporting shaft 7, the step 9 present between the head 8 and the shank 10 has a reinforcing portion 24 having an arcuate cross section formed fully along the outer circumference. Provided that the radius of the reinforcing portion 24 is r, the value r is set within the range of $0.1\ \text{mm} \leqq r \leqq 3\ \text{mm}$. The value r is more preferably set within the range of $0.2\ \text{mm} \leqq r \leqq 1.5\ \text{mm}$.

Referring to the thickness T of the bottom plate 23 present between the grooves 16, each bottom surface 21 is sloped or stepped from the mouth portion 17 toward the guiding portion 18 so that the thickness T is greater on the mouth portion (17) side than on the guiding portion (18) side. In other words, each groove 16 is designed to have such a depth as is slightly shallower on the mouth portion (17) side than on the guiding portion (18) side. Meanwhile, the distance W between the side wall surfaces 20 in each groove 16 is designed to be greater on the mouth portion (17) side than on the connecting portion (19) side or the pivotal guiding portion (18) side. Further, the supporting shaft 7 has a locking pin hole 25 formed in the head 8 thereof.

Figure 4A:
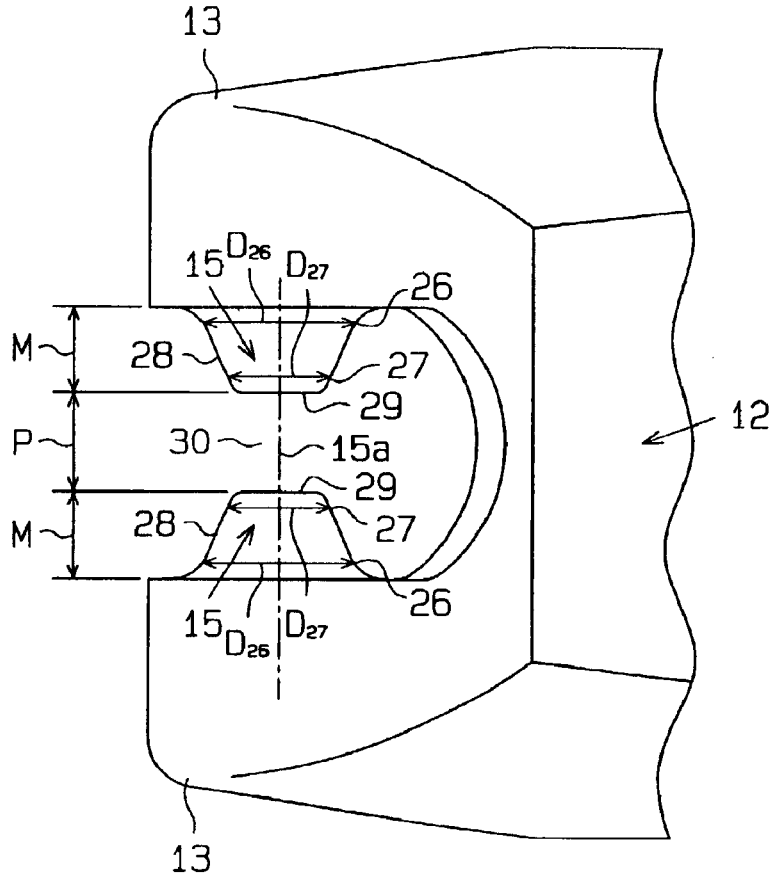
FIG. 4(*a*) is a partial plan view of the lever of the nail clipper.
Figure 4B:
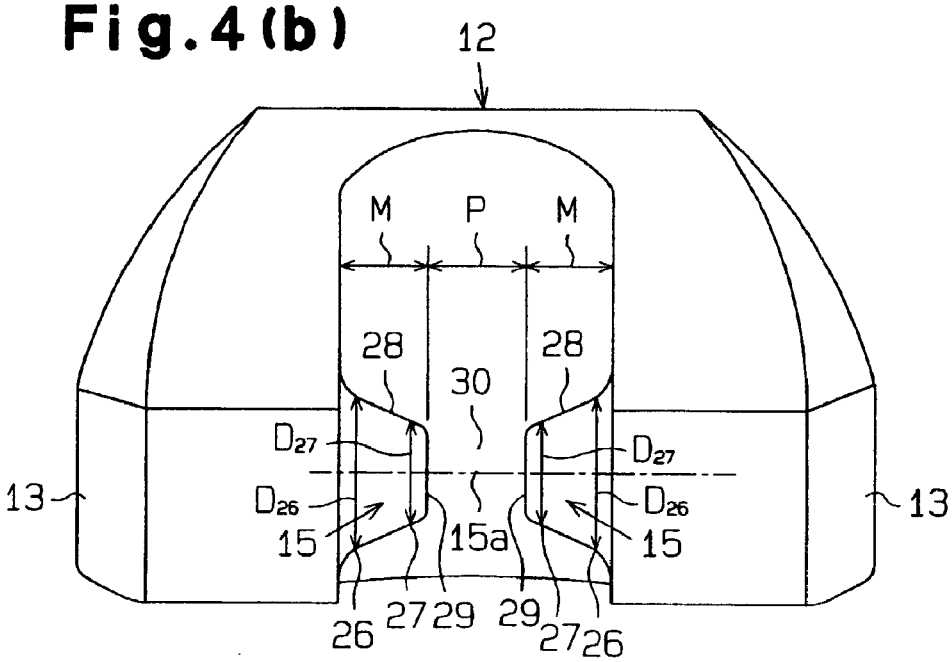

Next, the bosses 15 shown in FIG. 1(*c*) and FIGS. 4(*a*) and 4(*b*) will be described. Each boss 15 has a peripheral surface 28 formed to extend from a proximal portion 26 to a distal portion 27 thereof, and an end face 29 provided at the distal portion 27. In each boss 15, the cross section taken orthogonal to the axial direction 15*a* has a circular shape. The peripheral surface 28 is tilted with respect to the axial direction 15*a*. The peripheral surface 28 of each boss 15 is designed to have an outside diameter $D_{26}$ at the proximal portion 26, which is greater than the outside diameter $D_{27}$ of the same at the distal portion 27. Thus, a cross-sectional area of each boss 15 taken orthogonal to the axial direction 15*a* reduces gradually from the proximal portion (26) side toward the distal portion (27) side.

In each boss 15, provided that the outside diameter of the peripheral surface 28 at the proximal portion 26 and the length from the proximal portion 26 to the distal portion 27 in the axial direction 15*a* are $D_{26}$ and M respectively, and that the value $D_{26}$ (outside diameter)/M (length) is E, the value E is set within the range of $1 \leqq E \leqq 3$ in this embodiment. The value E is more preferably set within the range of $1.5 \leqq E \leqq 2.5$.

In the bosses 15, provided that the sum of the length M in the axial direction 15*a* from the proximal portion 26 to the distal portion 27 in one boss 15 and the length M in the axial direction 15*a* from the proximal portion 26 to the distal portion 27 in the other boss 15 is N (N=M+M), and the dimension of a clearance 30 secured between the distal portions 27 of the bosses 15 (i.e., the clearance between the end faces 29) is P, and that the value N (sum of lengths)/P (clearance) is F, the value F is set within the range of $1 \leqq F \leqq 3$ in this embodiment. The value F is more preferably set within the range of $1.3 \leqq F \leqq 2.3$.

Next, the procedures of coupling the bosses 15 with the grooves 16 respectively and supporting state between them will be described.

As shown in FIG. 5(*a*), in the state where the supporting shaft 7 penetrates through the upper and lower blade bodies 1 and 2, a locking pin (not shown) is inserted to the locking pin hole 25 formed at the head 8 of the supporting shaft 7 to achieve positioning of the supporting shaft 7, and also the upper blade body 1 is pushed down so that the cutting edges 3 and 4 of the blade bodies 1 and 2 approach each other. In this state, the supporting arms 13 of the lever 12 are applied onto the upper side of the upper blade body 1, and the bosses 15 of the supporting arms 13 are moved, on the upper side of the upper blade body 1, toward the grooves 16 formed at the upper end portion 11 of the shank 10 in the supporting shaft 7.

Next, as shown in FIGS. 5(*b*) and 6(*a*), each boss 15 is engaged with the mouth portion 17 of the opposed groove 16 while the upper end portion 11 of the shank 10 is inserted to the bearing recess 14 defined between the supporting arms 13. At the initial stage of engagement, each boss 15 approaches the side wall surfaces 20 of the groove 16 such that the peripheral surface 28 of the boss 15 slides along the side wall surfaces 20 of the groove 16 and that the end face 29 of the boss 15 slides along the bottom surface 21 of the groove 16.

Further, as shown in FIGS. 5(*c*) and 6(*b*), each boss 15 is slipped from the mouth portion 17 of the groove 16 into the guiding portion 18 through the connecting portion 19 in each groove. In the state where the boss 15 is fully engaged with the groove 16, the boss 15 is brought into pressure contact with the side wall surfaces 20 of the guiding portion 18 under the resilience of the upper and lower blade bodies 1 and 2 so as to regulate the boss 15 not to shift toward the connecting portion 19 of the groove 16.

Example of How the Nail Clipper is Used

In the state where the nail clipper is at rest as shown in FIG. 1(*a*), the lever 12 is turned over to rest on the upper side of the upper blade body 1, and the upper and lower blade bodies 1 and 2 are spaced vertically from each other under the resilience thereof. In this state, the resilience of the upper blade body 1 is borne by the bosses 15 and the grooves 16 formed in the shank 10 of the supporting shaft 7 through the supporting arms 13 of the lever 12; whereas the resilience of the lower blade body 2 is borne by the head 8 of the supporting shaft 7, maintaining the upper cutting edge 3 and the lower cutting edge 4 to be spaced away from each other.

Figure 7A:
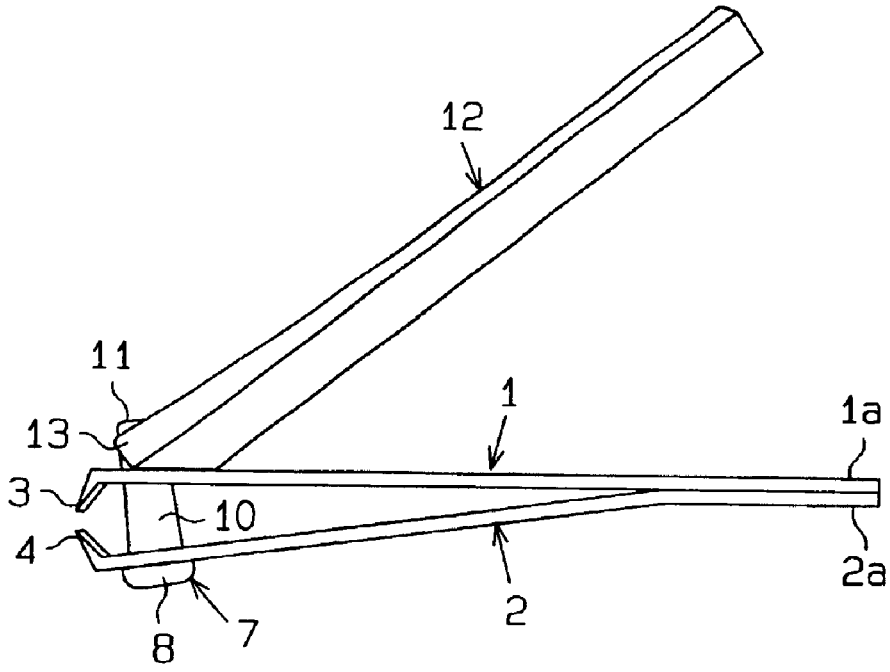
FIG. 7(*a*) is a front view of the nail clipper according to the first embodiment showing a state where the nail clipper is ready for use.
Figure 7B:
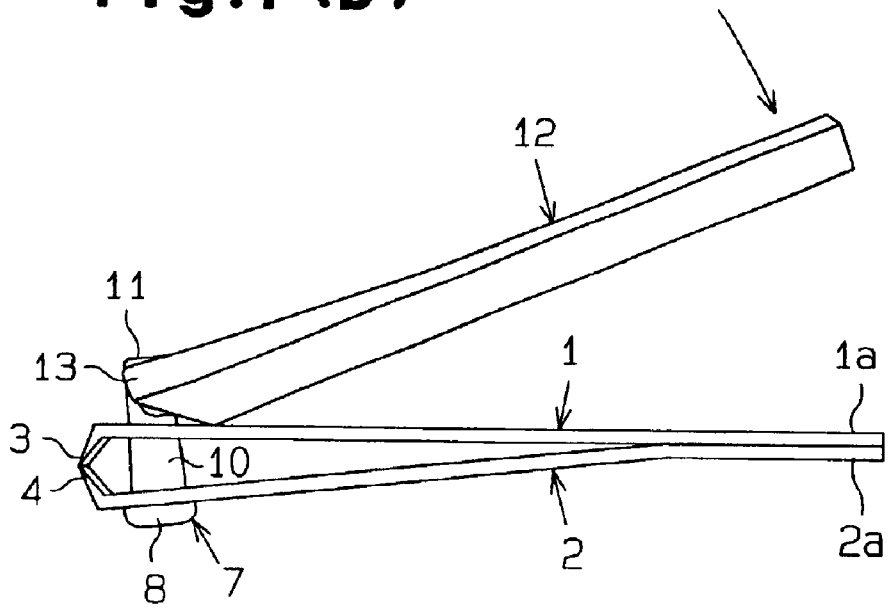
Figure 8A:
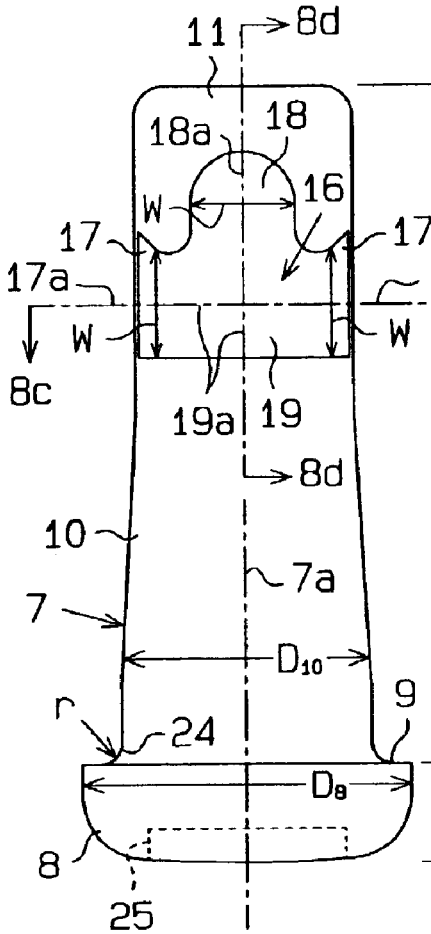
FIG. 8(*a*) is a front view showing the support shaft in the nail clipper according to another embodiment.
Figure 8B:
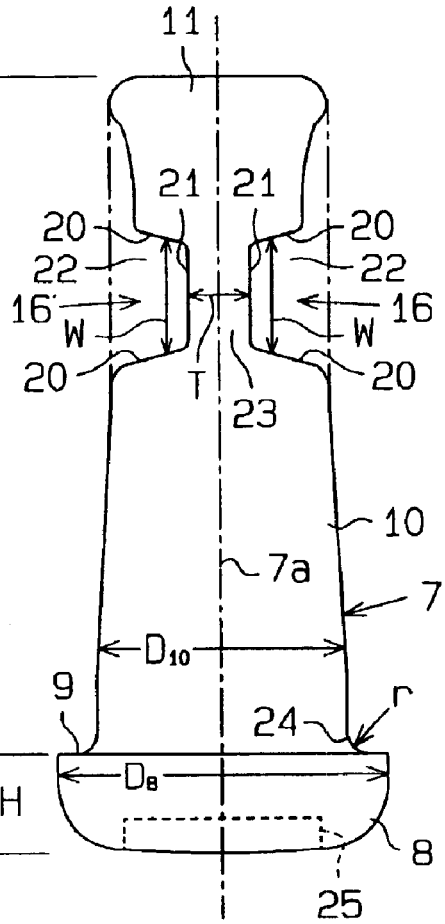
Figure 8B:
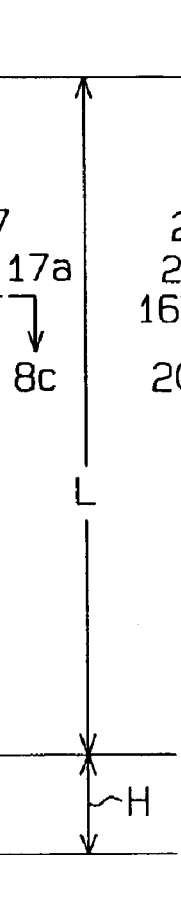
Figure 8C:
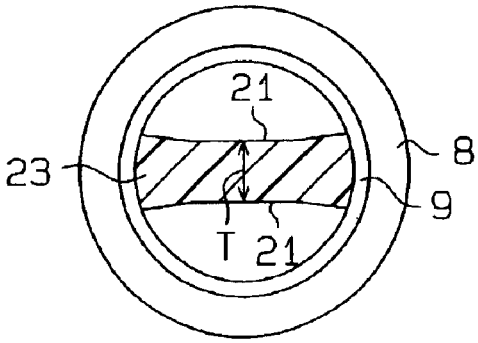
Figure 8D:
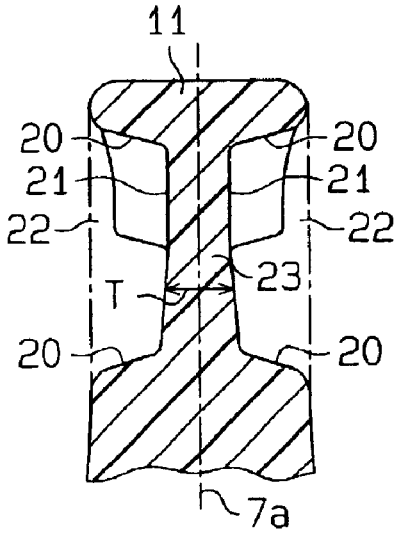

Next, the lever 12 is pivoted on the upper side of the upper blade body 1 by 180° together with the supporting shaft 7 and then inverted to be positioned over the upper blade body 1 so as to form an upward slope with respect to the blade body 1, as shown in FIG. 7(*a*) illustrating the state where the nail clipper is ready for use. Then, the upper blade body 1 is pressed with the lever 12 against the resilience of the upper and lower blade bodies 1 and 2, and the upper cutting edge 3 and the lower cutting edge 4 are brought closer and abutted against each other, as shown in FIG. 7(*b*) illustrating the state where the nail clipper is in action.

In any of the states described above, the bosses 15 of the lever 12 move within the guiding portions 18 of the respective grooves 16 defined in the supporting shaft 7 following the movement of the lever 12.

Other Embodiments

Another Embodiment Shown in FIG. 8

Figure 2A:
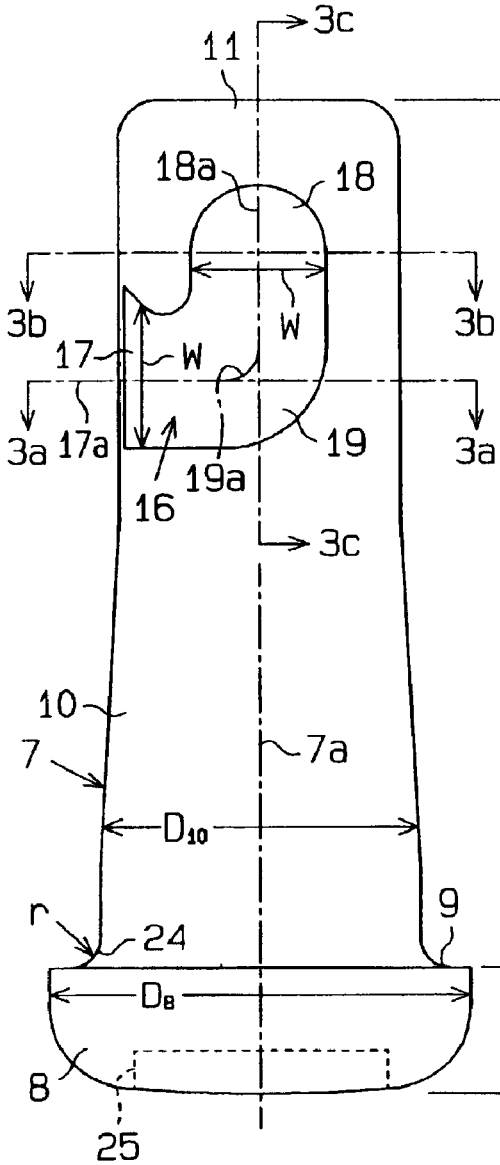
FIG. 2(*a*) is a front view of the supporting shaft of the nail clipper.
Figure 2B:
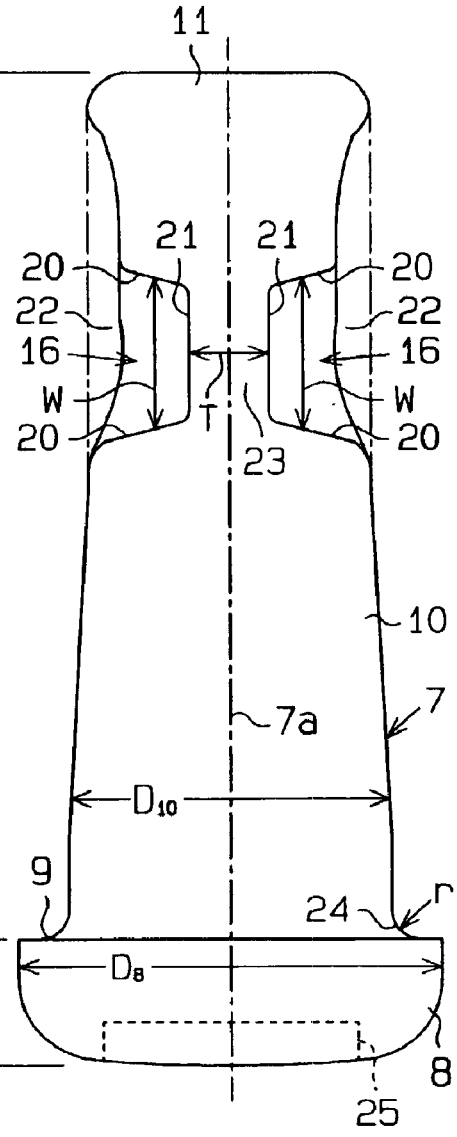
Figure 2C:
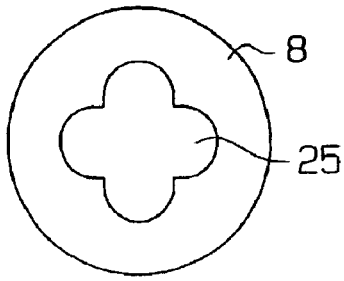

In the first embodiment shown in FIGS. 2(*a*) and 2(*b*), each groove 16 has the mouth portion 17 only on one side of the axial line 7*a* of the supporting shaft 7. However, in the embodiment shown in FIGS. 8(*a*) and 8(*b*), each groove 16 has a pair of mouth portions 17 on each side of the axial line 7*a* of the supporting shaft 7.

Figure 9A:
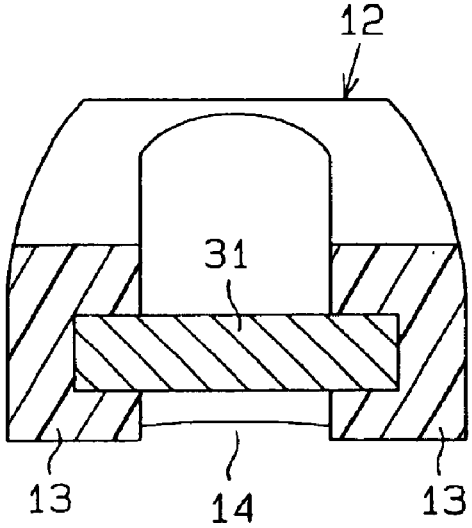
FIG. 9(*a*) is a cross-sectional view showing a transient step of forming bosses in the lever of the nail clipper according to another embodiment.
Figure 9B:
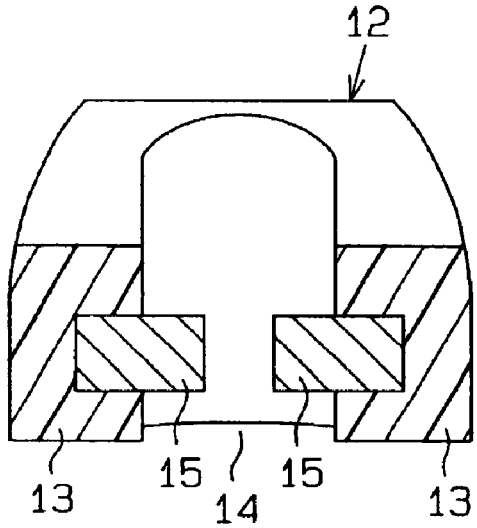

Another Embodiment Shown in FIG. 9

In the first embodiment shown in FIG. 1(*c*), the entire lever 12 including the bosses 15 is molded with a synthetic resin material. However, in the embodiment shown in FIG. 9(*a*), the main body of the lever 12 is molded with a synthetic resin material, and a metallic boss-forming material 31 is inserted to the supporting arms 13 to be integrated with the lever 12, and then the boss-forming material 31 is cut to form a pair of bosses 15.

Figure 10A:
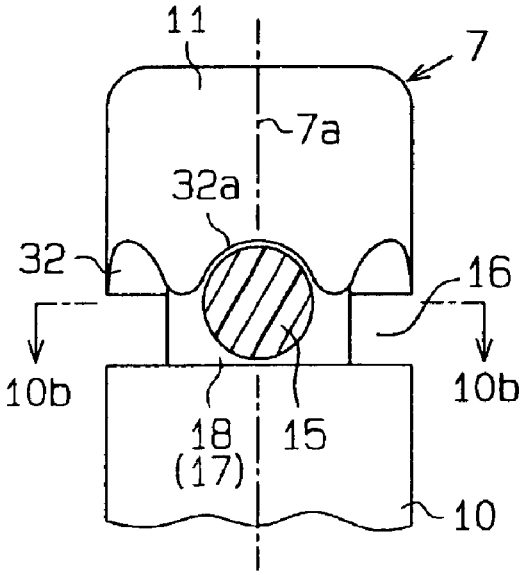
FIG. 10(*a*) is a front view showing the groove of the supporting shaft in the nail clipper according to another embodiment.
Figure 10B:
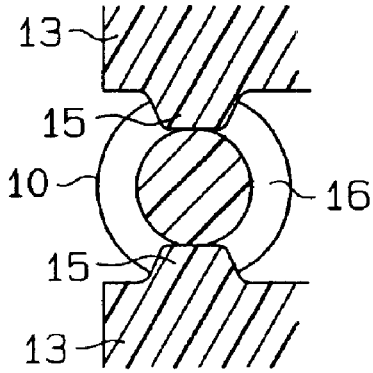

Another Embodiment Shown in FIG. 10

In the first embodiment, the grooves 16 are defined on the periphery of the shank 10 of the supporting shaft 7 to oppose diametrically each other. In place of this constitution, a groove 16 is formed fully along the circumference of the shank 10 of the supporting shaft 7. This groove 16 has an upper edge and a lower edge, and the upper edge has a wavy convexoconcavity 32. Further, a guiding portion 18 also serving as a mouth portion 17 is provided between each concavity 32*a* of the upper edge and the lower edge. The boss 15 in each supporting arm 13 of the lever 12 is introduced through this mouth portion 17 into the guiding portion 18.

Although not illustrated, the groove formed fully along the circumference of the shank 10 of the supporting shaft 7 may have the following constitution. A crosswise groove is formed on the shank 10 of the supporting shaft 7 in the circumferential direction. While the crosswise groove has an upper edge and a lower edge intersecting with the axial direction 7*a*, a plurality of vertical grooves are formed to extend parallelwise from the upper edge in the axial direction. The crosswise groove serves both as a mouth portion and as a connecting portion. Each vertical groove serves both as a connecting portion and as a guiding portion. The bosses 15 in the supporting arms 13 of the lever 12 are introduced from the mouth portion into the guiding portions through the connecting portions, respectively.

In any of the above embodiments, the supporting shaft 7 is provided with a groove or grooves 16, whereas each supporting arm 13 of the lever 12 is provided with a boss 15. Although not illustrated, in place of this configuration, a boss may be formed on the supporting shaft 7, and a groove may be formed on each supporting arm 13 of the lever 12.

Although not shown, the configuration of the boss 15 in each supporting arm 13 of the lever 12 may be modified. While the bosses 15 in the foregoing embodiments have a truncated cone shape, they may have, for example, a columnar or semispherical shape. Further, each boss 15 may have an elliptical cross section in place of the circular cross section.

What is claimed is:

1. In a nail clipper containing an upper blade body having an upper cutting edge; a lower blade body having a lower cutting edge opposed to the upper cutting edge; a supporting shaft inserted to the blade bodies near the cutting edges respectively, a lower end portion of the supporting shaft being engaged with the lower blade body, while an upper end portion of the supporting shaft protruding upward through the upper blade body; a lever having a pair of supporting arms; the upper end portion of the supporting shaft being inserted on the upper blade body to a bearing recess defined between the supporting arms of the lever; a first supporting section provided in the supporting arms; and a second supporting section provided at the upper end portion of the supporting shaft; the first and second supporting sections being linked to each other; the upper cutting edge and the lower cutting edge being brought into press contact with each other by pressing the upper blade body with the lever against resilience of the upper and lower blade bodies, wherein the improvement which comprises:

a pair of bosses opposing each other, formed as one of the group consisting of the first supporting section of the lever and as the second supporting section of the supporting shaft, and a pair of grooves formed as the other of the group consisting of the first supporting section of the lever and the second supporting section of the supporting shaft, with which the bosses are engaged respectively;

the grooves each having a mouth portion through which the boss is engaged and disengaged, a guiding portion capable of pivotally supporting the boss, and a connecting portion connecting the mouth portion and the guiding portion to each other; the groove having a pair of side wall surfaces opposing each other in the mouth portion, connecting portion, and guiding portion, and also a bottom surface connecting the side wall surfaces to each other.

2. The nail clipper according to claim 1, wherein the bosses formed as one supporting section are provided in the supporting arms respectively to oppose each other in the bearing recess of the lever, whereas the grooves formed as the other supporting section are defined on the circumference of the supporting shaft to oppose the bosses respectively.

3. The nail clipper according to claim 2, wherein the grooves defined in the supporting shaft are separated from each other by a bottom plate throughout the mouth portion, connecting portion, and guiding portion, and each groove has a bottom surface formed on the bottom plate throughout the mouth portion, connecting portion, and guiding portion.

4. The nail clipper according to claim 3, wherein either the distance between the bottom surfaces of the grooves or the thickness of the bottom plate is designed to be greater on the mouth portion side than on the guiding portion side.

5. The nail clipper according the claim 3, wherein provided that T represents the distance between the bottom surfaces of the grooves or the thickness of the bottom plate; $D_{10}$ represents the outside diameter of the supporting shaft; and A represents a value T (thickness)/$D_{10}$ (outside diameter), the value A is set within the range of $0 \leqq A \leqq 0.5$.

6. The nail clipper according to claim 2, wherein a central line between the side wall surfaces in each groove of the supporting shaft extends through the mouth portion, connecting portion, and guiding portion; and contains a first portion passing through the mouth portion, a second portion passing through the connecting portion, and a third portion passing through the guiding portion.

7. The nail clipper according to claim 6, wherein the second portion of the central line contains a portion extending from the mouth portion to the connecting portion orthogonal to the axial direction of the supporting shaft, and a portion extending from the connecting portion to the guiding portion in the axial direction of the supporting shaft.

8. The nail clipper according to claim 7, provided that W represents the distance between the side wail surfaces in the guiding portion of each groove; $D_{10}$ represents the outside diameter of the supporting shaft; and B represents a value W (distance)/$D_{10}$ (outside diameter), the value B is set within the range of $0.15 \leqq B \leqq 0.8$.

9. The nail clipper according to claim 2, wherein the distance W between the side wall surfaces of each groove is designed to be greater on the mouth portion side than on the connecting portion side or on the guiding portion side.

10. The nail clipper according to claim 2, wherein each boss has a proximal portion, a distal portion, a peripheral surface, and an end face at the distal portion; the boss has a cross-sectional area orthogonal to the axial direction of the boss, which cross-sectional area is designed to be greater on the proximal portion than on the distal portion.

11. The nail clipper according to claim 10, wherein the cross section of each boss orthogonal to the axial direction of the boss has a circular shape, and the outside diameter of the cross section of the boss reduces gradually from the proximal portion toward the distal portion.

12. The nail clipper according to claim 11, wherein provided that $D_{26}$ represents the outside diameter of the cross section of the proximal portion of each boss; M represents the axial length of the boss from the proximal portion to the distal portion; and E represents a value $D_{26}$ (outside diameter)/M (length), the value E is set within the range of $1 \leqq E \leqq 3$.

13. The nail clipper according to claim 11, wherein provided that N represents the sum of the lengths M in the pair of bosses; P represents the distance between the end faces of the bosses; and F represents a value N (sum of lengths)/P (distance), the value F is set within the range of $1 \leqq F \leqq 3$.

14. The nail clipper according to claim 2, wherein the side wall surfaces in each groove of the supporting shaft are provided adjacent to each other so that they are substantially in contact with the peripheral surface of the boss of the lever.

15. The nail clipper according to claim 14, wherein the distance W between the side wall surfaces in each groove of the supporting shaft is designed to be greater on the opening side than on the bottom surface side such that the distance W becomes smaller toward the deeper side of the groove.

16. The nail clipper according to claim 2, wherein the supporting shaft has a head located at the lower end thereof and a shank formed contiguous to the head through a step; the head has an outside diameter $D_8$, which is greater than the outside diameter $D_{10}$ of the shank; and provided that H represents the axial length of the head, L represents the axial length of the shank, and C represents a value H (width)/L (length), the value C is set within the range of $0.05 \leqq C \leqq 0.3$.

17. The nail clipper according to claim 16, wherein the step formed between the head and the shank in the supporting shaft is provided with a reinforcing portion having an arcuate cross section formed fully along the periphery thereof, and provided that r represents the radius in a cross sectional profile of the reinforcing portion, the value r is set within the range of 0.1 mm $\leqq r \leqq$ 3 mm.

18. The nail clipper according to claim 2, wherein, when the boss is supported in the guiding portion of the groove, the boss is brought into press contact with the side wall surfaces of the guiding portion under resilience of the upper and lower blade bodies so that the boss does not shift toward the connecting portion of the groove.

19. The nail clipper according to claim 2, wherein each groove has a pair of mouth portions defined on each side of the axial line of the supporting shaft.

20. The nail clipper according to claim 2, wherein the bosses on the supporting arms of the lever are made of a metal, and in the case where the lever is molded with a synthetic resin material, the bosses are formed integrally with the lever using an insert.

21. The nail clipper according to claim 2, wherein the supporting shaft has at the lower end a locking pin hole.

22. In a nail clipper containing an upper blade body having an upper cutting edge; a lower blade body having a lower cutting edge opposed to the upper cutting edge; a supporting shaft inserted to the blade bodies near the cutting edges respectively, a lower end portion of the supporting shaft being engaged with the lower blade body to be locked therewith, while an upper end portion of the supporting shaft protrudes upward through the upper blade body; and a lever having a pair of supporting arms; the upper end portion of the supporting shaft being inserted on the upper blade body to a bearing recess defined between the supporting arms of the lever; a first supporting section provided in the supporting arms; and a second supporting section provided at the upper end portion of the supporting shaft; the first and second supporting sections being linked to each other; the upper cutting edge and the lower cutting edge being brought into press contact with each other by pressing the upper blade body with the lever against resilience of the upper and lower blade bodies, wherein the improvement which comprises:

a pair of bosses protruding as the first supporting section of the lever from the supporting arms respectively to oppose each other in the bearing recess of the lever; and a groove, with which the bosses are engaged, formed as the second supporting section of the supporting shaft on the circumference thereof; the groove being formed continuously fully along the circumference of the supporting shaft and having a mouth portion through which the bosses are engaged and disengaged and a guiding portion capable of pivotally supporting the bosses.

* * * * *

UNITED STATES PATENT AND TRADEMARK OFFICE

CERTIFICATE OF CORRECTION

PATENT NO. : 6,904,683 B2
DATED : June 14, 2005
INVENTOR(S) : Yasuyuki Shinoda et al.

It is certified that error appears in the above-identified patent and that said Letters Patent is hereby corrected as shown below:

Column 9,
Line 46, after "claim 7," insert -- wherein --.
Line 47, "wail" should read -- wall --.

Signed and Sealed this

Twenty-third Day of August, 2005

JON W. DUDAS
*Director of the United States Patent and Trademark Office*